US006302833B1

(12) United States Patent
Ellis et al.

(10) Patent No.: US 6,302,833 B1
(45) Date of Patent: Oct. 16, 2001

(54) MULTI-FUNCTION EXERCISE MACHINE

(75) Inventors: Patrick D. Ellis, Oak Creek; Fred A. Malicki, Wauwatosa, both of WI (US)

(73) Assignee: Northland Industries, Inc., South Milwaukee, WI (US)

( * ) Notice: Subject to any disclaimer, the term of this patent is extended or adjusted under 35 U.S.C. 154(b) by 0 days.

(21) Appl. No.: 09/492,720

(22) Filed: Jan. 31, 2000

(51) Int. Cl.[7] ..... A63B 21/062; A63B 23/02

(52) U.S. Cl. ..... 482/100; 482/100; 482/136; 482/138; 482/142; 482/908

(58) Field of Search ..... 482/99, 100, 102, 482/103, 135–139, 908, 142

(56) References Cited

U.S. PATENT DOCUMENTS

| | | | | |
|---|---|---|---|---|
| 4,621,807 | | 11/1986 | Stramer . | |
| 4,898,381 | | 2/1990 | Gordon . | |
| 4,982,955 | * | 1/1991 | Heasley | 482/100 |
| 5,102,121 | * | 4/1992 | Solow et al. | 482/94 |
| 5,336,148 | | 8/1994 | Ish, III . | |
| 5,356,360 | * | 10/1994 | Johns | 482/99 |
| 5,370,595 | | 12/1994 | Voris et al. . | |
| 5,401,227 | | 3/1995 | Webber . | |
| 5,419,751 | * | 5/1995 | Byrd et al. | 482/138 |
| 5,447,480 | | 9/1995 | Fulks . | |
| 5,456,644 | * | 10/1995 | Hecox et al. | 482/127 |
| 5,549,530 | * | 8/1996 | Fulks | 482/100 |
| 5,554,085 | | 9/1996 | Dalebout . | |
| 5,722,921 | | 3/1998 | Simonson . | |
| 5,785,635 | | 7/1998 | Gerschefske et al. . | |
| 5,800,310 | | 9/1998 | Jones . | |
| 5,800,321 | | 9/1998 | Webber . | |
| 5,810,701 | | 9/1998 | Ellis et al. . | |
| 5,823,920 | | 10/1998 | Grider . | |
| 6,162,153 | * | 12/2000 | Perez, Jr. et al. | 482/96 |

* cited by examiner

*Primary Examiner*—Mickey Yu
*Assistant Examiner*—Victor Hwang
(74) *Attorney, Agent, or Firm*—Andrus, Sceales, Starke & Sawall, LLP

(57) ABSTRACT

An exercise machine includes a frame, a seat adjustably mounted on the frame, and a rest attached to the frame rearwardly of the seat for supporting the upper torso of an exerciser. A lever arm assembly includes a pair of lever arms movably connected relative to the frame about at least one horizontal pivot shaft between a starting position and a finishing position, and structure is provided on the frame for resisting movement of the lever arm assembly. A conversion arrangement is connected between the frame and the lever arms for changing the starting position of the lever arms so as to provide for different exercise movements.

11 Claims, 14 Drawing Sheets

MULTI-FUNCTION EXERCISE MACHINE

FIELD OF THIS INVENTION

This invention relates broadly to an exercise apparatus and, more particularly, pertains to an exercise apparatus which is capable of performing a variety of exercises for different muscle groups in a single seat machine.

BACKGROUND OF THE INVENTION

Responsive to the growing demand for exercise machines capable of performing a variety of motions, various types of multiple function exercise apparatus have been developed which have different structural arrangements of levers, pulleys and cables used in the performance of various physical exercises. Many exercise machines of the above-described type are large cumbersome machines having several individual stations positioned adjacent one another on a central framework for the execution of several different exercises. The overall size and number of elements makes them costly, inappropriate to use in certain areas, and causes their assembly and transport to be difficult. Continuous efforts are being made to reduce the size of these multi-function devices which often impairs the machine's ability to offer a thorough workout.

To optimize the weight training benefit provided by a multi-function exercise machine, it is desirable that moving parts of the machine move smoothly through a fall range of motion and preferably without inflicting stress on the exerciser's joints. It is also desirable that such an exercise machine be adjustable to accommodate physiques of different users, both in terms of body strength and size. Moreover, it is desirable that the machine be easily convertible at a single station so as to provide exercise to several different body parts. Further, it is desirable to provide an exercise device which is easy to use and cost effective to manufacture.

SUMMARY OF THE INVENTION

It is one object of the present invention to provide a multi-function exercise machine.

It is a further object of the present invention to provide a pressing machine capable of exercising muscles of the upper torso.

It is also an object of the present invention to provide a lever arm exercise apparatus equipped with a conversion arrangement for selectively altering the starting position of the lever arms so as to enable different exercise movements.

Still another object of the present invention is to provide an exercise unit which will enable full resistance over an entire range of exercise motion with minimum stress on the shoulder, elbow and wrist joints.

Yet another object of the present invention is to provide a single seat station from which an exerciser can perform a shoulder press, an inclined bench press, and a lat pull-down.

In one aspect of the invention, an exercise machine includes a frame, a seat adjustably mounted on the frame and a rest attached to the frame rearwardly of the seat for supporting the upper torso of an exerciser. A lever arm assembly including a pair of lever arms is movably connected relative to the frame about at least one horizontal pivot shaft between a starting position and a finishing position. Structure is provided on the frame for resisting movement of the lever arm assembly. A conversion arrangement is connected between the frame and the lever arms for changing the starting position of the lever arms so as to provide for different exercise movements. The conversion arrangement is defined by a spring pin-actuated, movable plate, pulley and cable combination.

The conversion arrangement includes a range control plate fixed to the pivot shaft and lever assembly and having a set of slots formed therein. A resistance lever assembly is pivotably mounted on the pivot shaft adjacent the range control plate. A pin plate assembly is pivotably mounted on the pivot shaft adjacent the resistance lever assembly and includes a pin biased into engagement with one of the slots in the range control plate. A mounting plate is fixed to the lever arm assembly adjacent the pin plate assembly and has an opening through which the pivot shaft passes. With the conversion arrangement, the starting position of the lever arm assembly is established by the position of the pin in one of the slots of the range control plate. The resistance lever assembly is comprised of an upper resistance lever and a lower resistance lever. Each of the resistance lever members has a proximal end being mounted about the pivot shaft for independent movement relative to the other resistance member and having a distal end provided with a pulley rotatably mounted thereon and a cable clamp movably fixed thereto. The distal end of each upper and lower resistance lever is engageable with a stop mounted on the frame of the machine. The pin of the pin plate assembly extends through the resistance lever assembly. The exercise machine includes a floating idler pulley, a first guide pulley mounted to a lower portion of the frame, at least one second guide pulley mounted to an upper portion of the frame and a support cable connected to the idler pulley, wound about the first guide pulley and second guide pulley and joined to the resisting structure. A third guide pulley is mounted to an upper portion of the frame and a main cable is attached to the cable clamp on the upper resistance lever and wound around the pulley on the lower resistance lever, the third guide pulley, the idler pulley, and the pulley on the upper resistance lever and attached to the cable clamp on the lower resistance lever.

A motion translation arrangement is connected to the lever arms and is pivotably mounted to the frame about at least one horizontal axis and defines a pair of spaced, parallel, angularly-oriented pivot axes lying perpendicularly to the horizontal axis. A carriage is pivotally mounted to the frame about a major horizontal axis and a minor horizontal axis located substantially parallel to the major horizontal axis. The carriage defines a pair of spaced, parallel, angularly-oriented, pivot axes lying perpendicular to the major and minor horizontal axes, and having a pair of transfer linkages. Each linkage is rigidly connected at one end to one of the lever arms and is pivotally connected at another end to the frame about the minor horizontal axis. Movement of the lever arms and carriage about the major and minor horizontal axes will be translated into lateral motion of the lever arms about the pivot axes such that each lever arm moves in a curved path from one location to a second location. Each transfer linkage is comprised of a rigid mounting arm connected to one of the lever arms, and a transfer link extending rearwardly of the mounting arm and being connected between the mounting arm and the frame. The machine is constructed and arranged to selectively provide a shoulder pressing motion, an inclined bench pressing motion and a lat pull-down motion.

In another aspect of the invention, an exercise machine has a frame, a seat mounted on the frame, a rest attached to the frame rearwardly of the seat for supporting the torso of an exerciser, a pair of lever arms pivotally mounted about a horizontal axis relative to the frame between a starting position and a finishing position and structure for resisting movement of the lever arms. The invention is improved by a conversion arrangement mounted between the frame and the lever arms for selectively changing the starting position of the lever arms to provide for different exercise movements. The conversion arrangement includes a plate assembly pivotally mounted about the horizontal axis, and a pulley and cable system connected to the plate assembly. The seat and the rest are adjustably mounted on the frame. The lever arms are positionable upwardly and outwardly from an upper portion of the frame. The lever arms are also positionable downwardly and outwardly from an upper portion of the frame.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
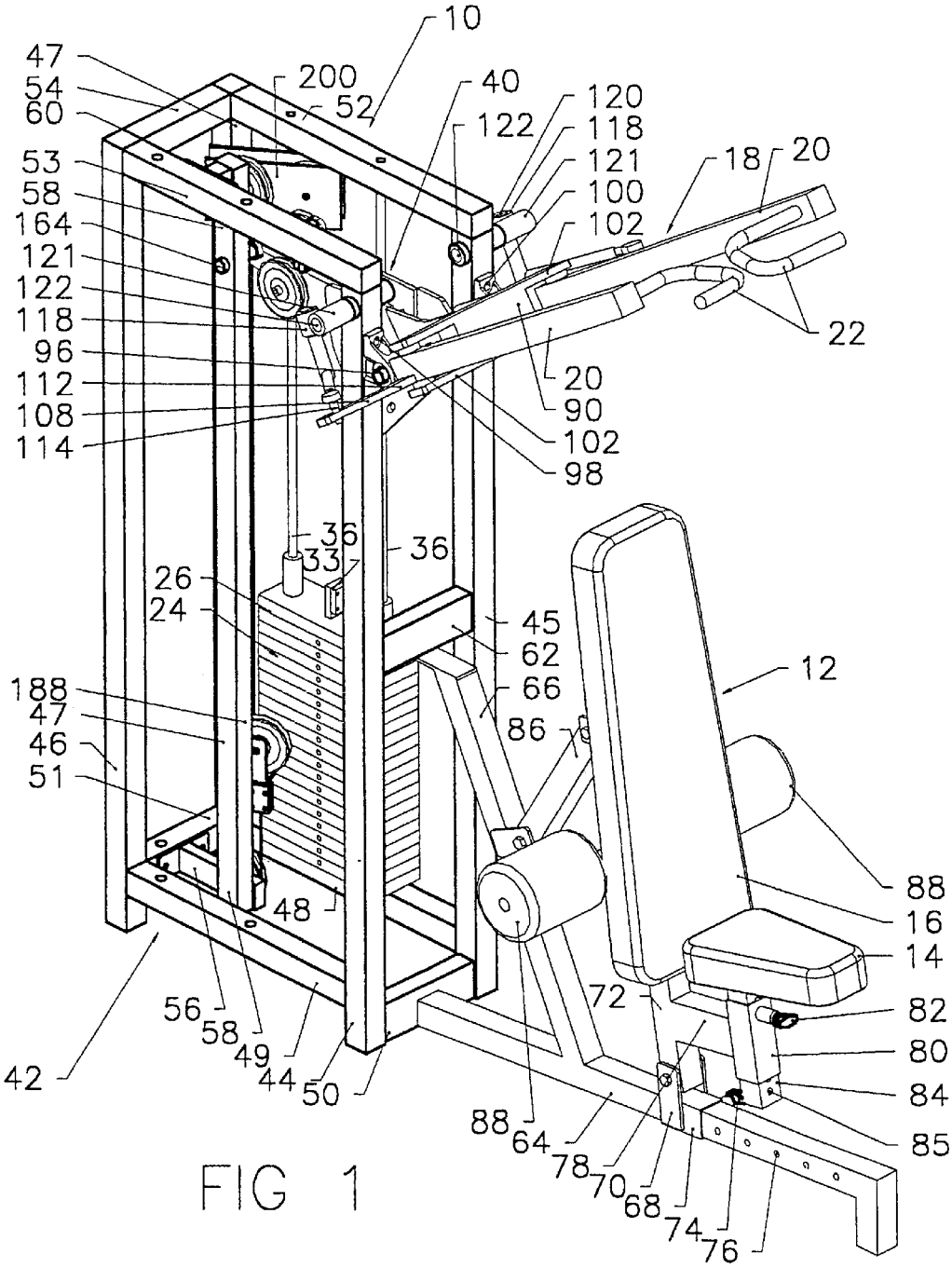
FIG. 1 is a perspective view of a multi-function, lever arm exercise machine employing the present invention.

Referring now to the drawings, the present invention is embodied in a repetitive, multi-function, exercise machine indicated generally by the reference numeral 10. In each of the illustrated embodiments, the exercise device 10 is configured for a human user to exercise by sitting, forwardly or rearwardly, in an adjustable seat 12 having a seat bottom 14 and a combination chest/back rest 16. A lever arm assembly 18 having a pair of lever arms 20 extends forwardly from behind the seat 12 and terminates at a position thereabove. Each of the lever arms 20 has a C-shaped, rubber-covered, hand grip 22 for grasping by the corresponding hands of the user sitting in the seat 12. Exercise is achieved by grasping both hand grips 22 while sitting in the seat 12 and pulling downward or pushing upward from a starting position to a finishing position to apply a moving force to the lever arms 20 to overcome a loading force applied thereto by a resisting structure 24.

Figure 2A:
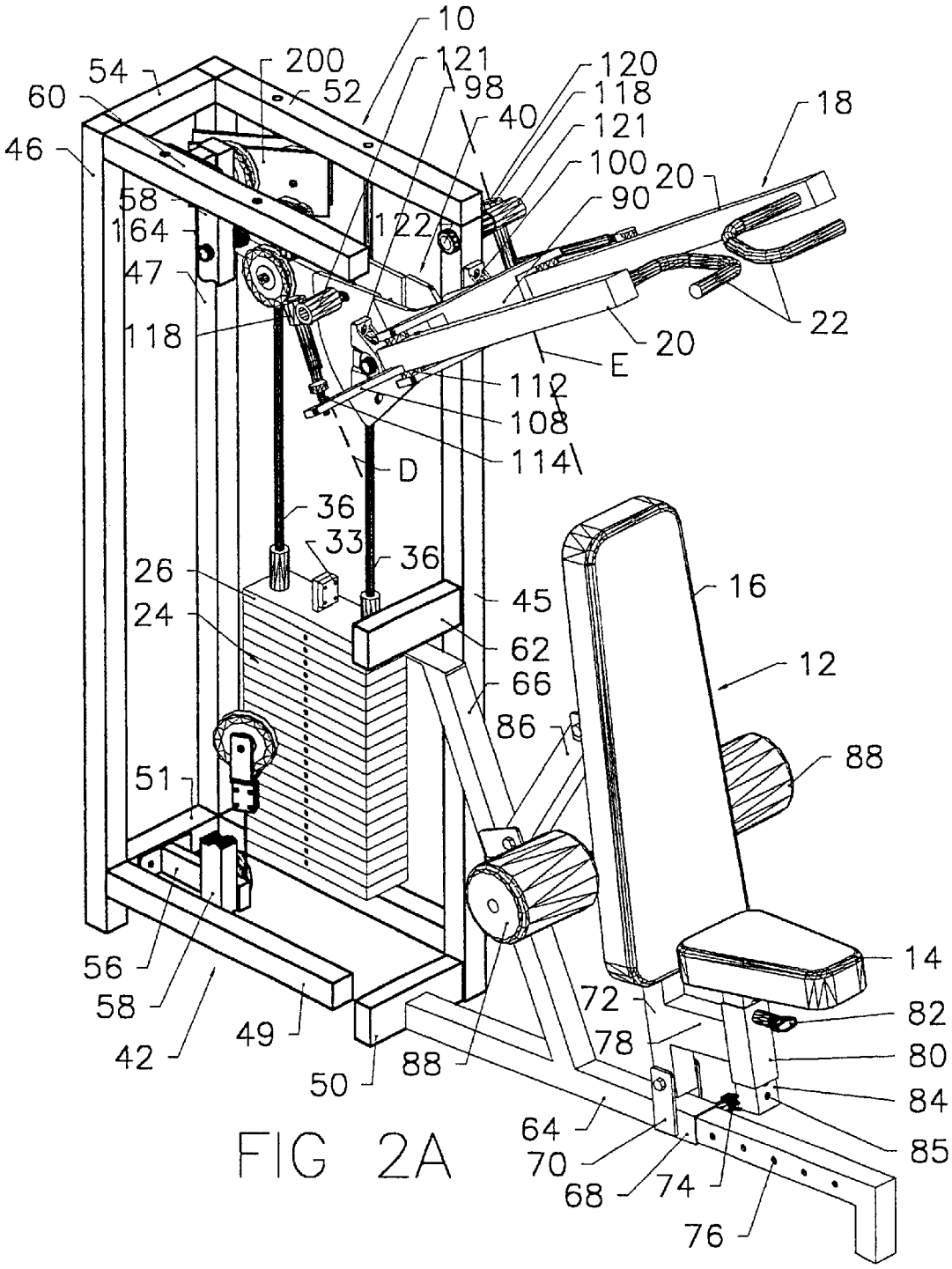
FIG. 2A is a fragmentary view of the exercise machine of FIG. 1 showing the details of a conversion arrangement in accordance with the present invention and showing the exercise machine in a starting position for a lat pull-down.
Figure 2B:
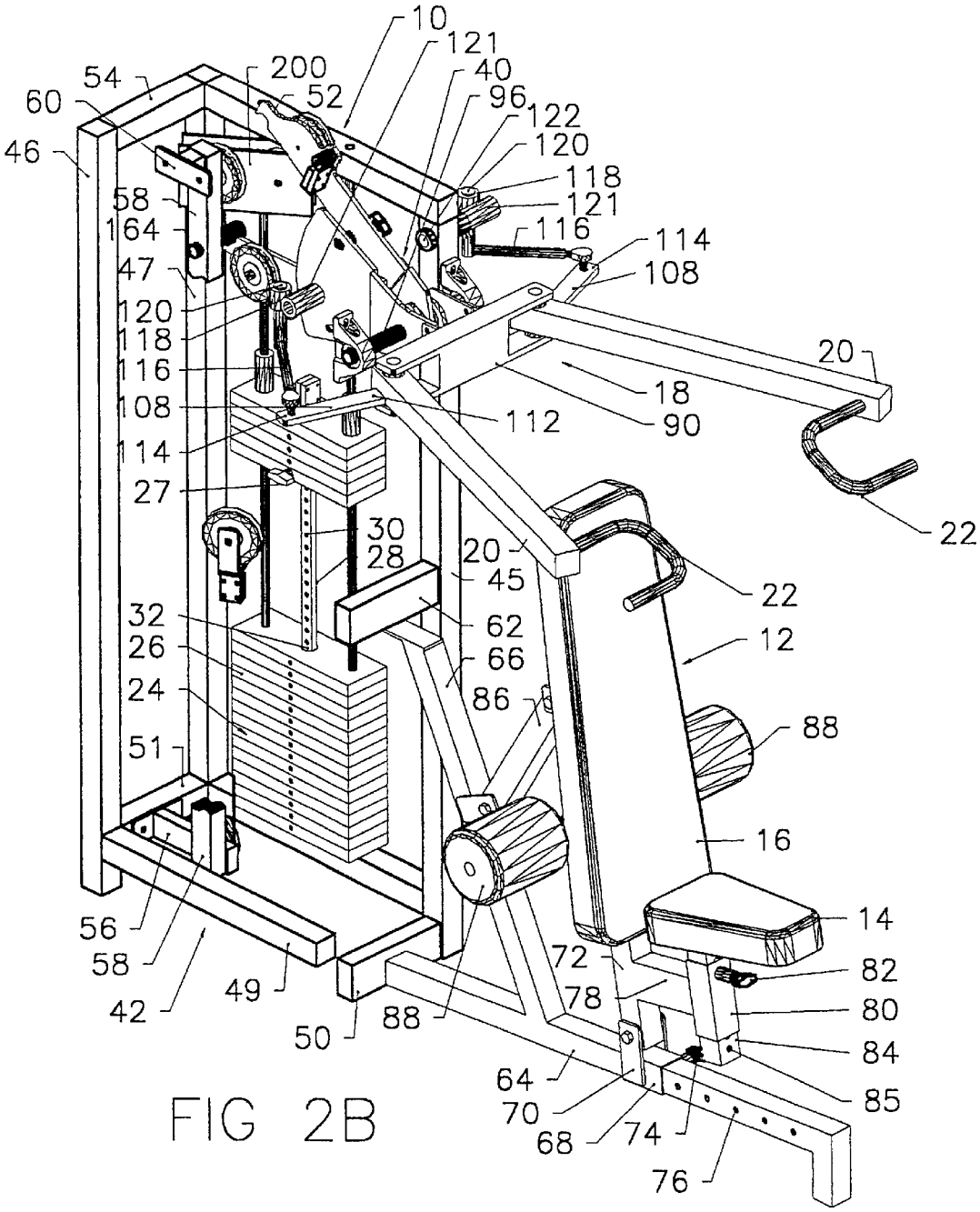
FIG. 2B is a fragmentary view of an exercise machine of FIG. 1 in a finishing position for the lat pull-down.

As is well known, the resisting structure 24 generally takes the form of a set of weights 26 of equal size arranged in a vertical stack. A selector rod 28 (FIG. 2B) having a series of apertures 30 formed therein passes through a central opening 32 in each of the weights 26 and is operably connected via cable clamp 33 (FIG. 4) at its upper end to a support cable 34. The cable 34 lifts the rod 28 and any weights 26 attached thereto along a pair of parallel guide rods 36 in response to the user pulling or pushing on an input member, such as the lever arms 20, which is connected through various pulleys to the cable 34. The amount of weight lifted by the user depends upon the number of weights 26 which are connected to the selector rod 28. The weights 26 are generally arranged in ten or twenty pound increments, and a removable pin 27 is provided which must be manually positioned in a desired selector rod aperture 30 by the user to pin a selective one or more of the weights 26 to the selector rod 28 for movement with the rod. Of course, each of the weights 26 positioned above the selected weight pinned to the selector rod 28 is also lifted with the rod.

The weights 26 are coupled to the lever arms 20 in a manner in accordance with the present invention by a conversion arrangement 40 effectively changing the starting position of the lever arms 20 as will be described in detail below. The application of a moving force to the lever arms 20 greater than the loading force results in lifting the weights 26 upward. Exercise is also achieved by applying a resisting force to the lever arms 20 less than the loading force to resist the return movement of the weights 26 as they move downward.

It is noted that while the exercise machine 10 is disclosed in terms of an upper body or upper torso machine where the user's arms are utilized to move and resist movement of the lever arms 20, the present invention is equally applicable to machines where the exerciser sits in the seat 12 and uses the legs to move and resist movement of any type of apparatus where the user achieves exercise by lifting, pulling or pushing some type of coupling member to apply a moving or resisting force thereto. Further, it should be appreciated that while the invention is described herein with the loading force being applied by the weight stack 24, the loading force can be alternatively supplied by removable spindle-mounted, weight plate(s), a spring, a pneumatic cylinder, or any other device which may be coupled to the lever arms 20 such that a moving or resisting force applied thereto by the user will result in performing a desired exercise.

In the description to follow, references to the terms "front", "rear", "left", "right", "upper" and "lower" are taken from the perspective of an exerciser seated with his or her back against the rest 16.

As shown in FIG. 1, the exercise machine 10 includes a floor engaging frame 42 constructed of a series of straight sections of heavy duty, tubular steel which are welded together. In particular, the frame 42 is comprised of a pair of parallel front uprights 44,45 and a pair of parallel, rear uprights 46,47, which are joined together at their lower extremities by a pair of parallel, left and right side, lower rails 48,49, respectively, and a pair of parallel front and rear, lower cross members 50,51, respectively. The upper extremities of the uprights 44–47 are secured together by a pair of parallel, left and right side, upper rails 52,53, respectively, and a rear upper cross member 54. A first T-shaped bar bracket 56 extends forwardly from the rear lower cross member 51 and supports the bottom end of a vertical support stanchion 58. A second T-shaped bar bracket 60 projects inwardly from the right side upper rail 53 and is connected to the upper end of the support stanchion 58. The front uprights 44,45 are bolstered by an intermediate cross member 62 which lies generally perpendicular to the uprights 44,45 between the upper and lower ends thereof.

Extending forwardly from the front, lower cross member 50 is an elongated base member 64 upon which the seat 12 is adjustably mounted. An angular brace 66 integrally connects the base member 64 with the intermediate cross member 62. The base member 64 carries an adjustable sleeve 68 which is joined to a pair of connector plates 70 that are pivotally secured to the bottom of a front leg 72 supporting the chest/back rest 16. The sleeve 68 is provided with a first spring set positioning pin 74 which enables fore and aft adjustability of the joint seat bottom 14 and the chest/back rest 16. Appropriately aligned openings 76 formed in the base member 64 receive the positioning pin 74. The front leg 72 has a forwardly extending tongue 78 having a hollow tubular member 80 connected substantially perpendicularly thereto. The tubular member 80 carries a second spring-set, positioning pin 82 which provides for the up-ward and downward adjustability of the seat bottom 14 having a downwardly projecting tubular support post 84. Aligned apertures 85 formed in the tubular support post 84 receive the second positioning pin 82. The seat bottom 14 is adapted to be positioned at various heights so as to provide a comfortable seated position for the exerciser and allow a full range of motion for a user of varying stature. A support strut 86 has a lower end pivotably joined to the brace 66, and an upper end pivotably secured to the chest/back rest 16. The movable strut 86 and the adjustability of the sleeve 68 along the base member 64 enables an exerciser to maintain a sedentary position with his or her upper torso supported between a nearly vertical position and a more reclined position. The seat bottom 14 and chest/back rest 16 combine to create a support system for ensuring the comfort of the user and establishing the necessary position to obtain the maximum benefit of the desired exercise movement. A pair of cylindrical support cushions 88 extend laterally from the lower portion of the chest/back rest 16 and are adapted to be engaged with the knees of an exerciser when one assumes an exercise position in which the chest is engaged against the rest 16 as will be further discussed hereafter.

In the preferred embodiment, the exercise machine 10 includes a motion translation arrangement, such as fully described in assignee's U.S. Pat. No. 5,810,701 which issued Sep. 22, 1998 and is herein incorporated by reference. The motion translation arrangement takes the form of a rotatable carriage 90 defined by a H-shaped body which couples the lever arms 20 via a pair of mounting tabs 92,94 (FIG. 3A) to a horizontal pivot shaft 96. The ends of pivot shaft 96 are pivotally mounted in a pair of spaced left and right side, pillow block bearings 98,100 which are each affixed to an upper forward portion of the front uprights 44,45, such as by bolts and nuts. With the above-described structure, the entire carriage 90 is rotatable about a major horizontal axis A (FIGS. 3A, 3B and 4) which is coaxial with the longitudinal axis of the pivot shaft 96. The opposite ends of the body or carriage 90 are formed with clevis-like ends 102 which define the location of a pair of spaced, angularly-oriented, pivot axes B,C (FIG. 3B) about which the lever arms 20 swing inwardly and outwardly relative to the chest/back rest 16. The pivot axes B,C are disposed generally perpendicularly to the longitudinal axis of the pivot shaft 96. A rearward end of each lever arm 20 includes a stub shaft 104 rotatable in bearings 106 about pivot axes B,C.

Figure 3A:
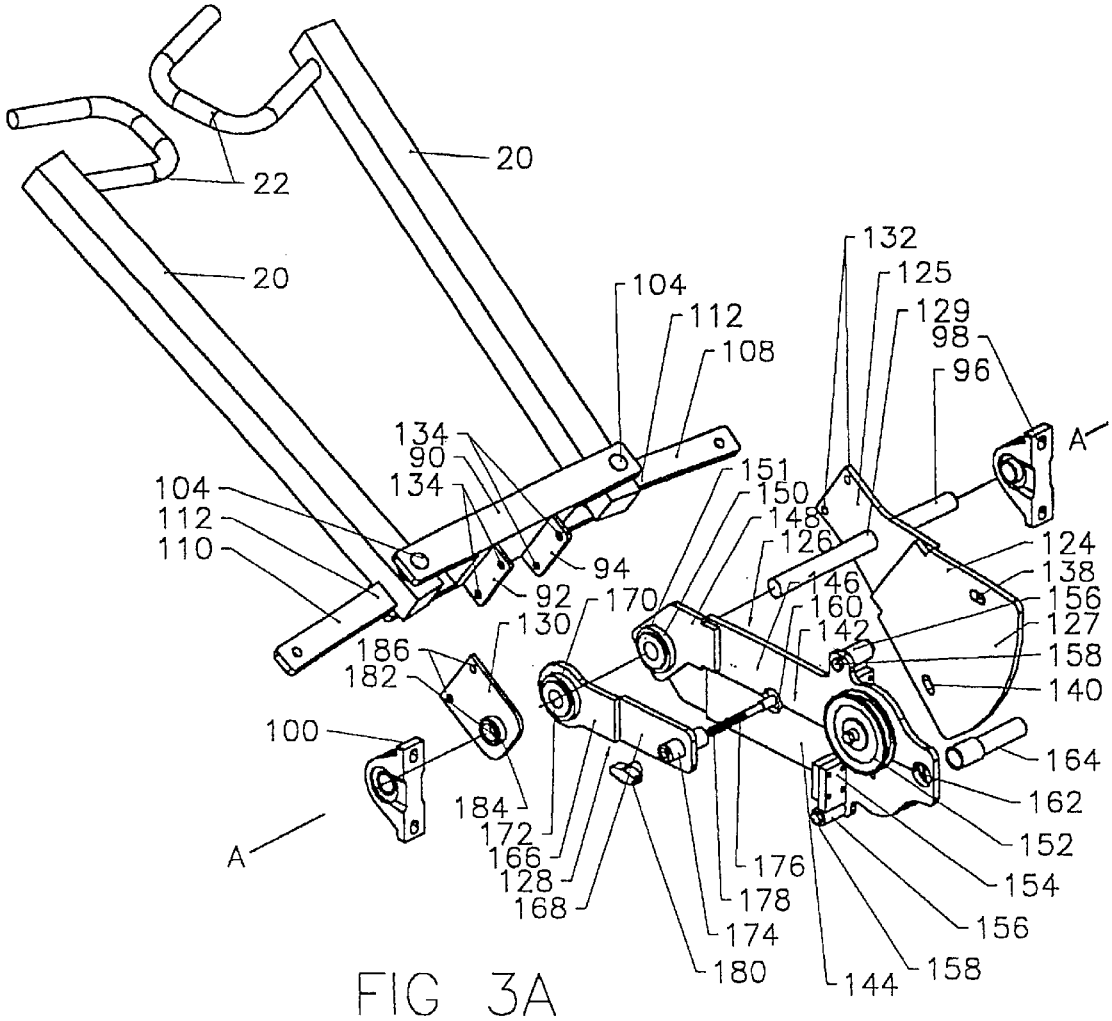
FIG. 3A and 3B are exploded views of the conversion arrangement relative to the lever arm assembly taken from the right and left hand sides respectively.

Extending outwardly and rearwardly from the lever arms 20 is a pair of rigid mounting arms 108,110 (FIG. 3A). Each of the mounting arms 108,110 has a proximal end 112 welded to the rearward side of each lever arm 20, and a distal end 114 (FIGS. 2A,2B) having a movable joint. A forward end of an L-shaped transfer link 116 (FIG. 2B) movably connected to each mounting arm 108,110 has a bearing which swivels about the movable joint as the carriage 90 is rotated about the axis of pivot shaft 96 or the major horizontal axis A. The rearward end of each transfer link 116 includes a sleeve 118 rotatable about a rod 120. Each of the rods 120 define a second set of angularly-oriented, pivot axes D,E (FIG. 2A) about which the transfer links 116 pivot. Each of the sleeves 118, in turn, is welded to a horizontally disposed sleeve 121 rotatable about an elongated shaft 122 passing through the front uprights 44,45. The longitudinal axes of shafts 122 are coaxial and define a minor horizontal axis F (FIG. 4) about which the carriage 90 also rotates. The axis F is parallel to, behind and above the major horizontal axis A (the axis of shaft 96). Together, the mounting arms 108,110 and the transfer links 116 create a pair of transfer linkages, each being rigidly connected at one end of the lever arms 20 and pivotally connected at the other end to the frame 42 about the minor horizontal axis F. The motion translation arrangement enables full resistance over an entire range of exercise motion with a minimum of stress on the shoulder, elbow and wrist joints.

In accordance with the present invention, the conversion arrangement 40 is connected between the frame 42 and the lever arms 20 for changing the starting position of the lever arms 20 so as to provide for different exercise movements using a one seat machine. In the preferred embodiment, the conversion arrangement 40 is defined by a spring pin-actuated, movable plate, pulley and cable arrangement.

Figure 3B:
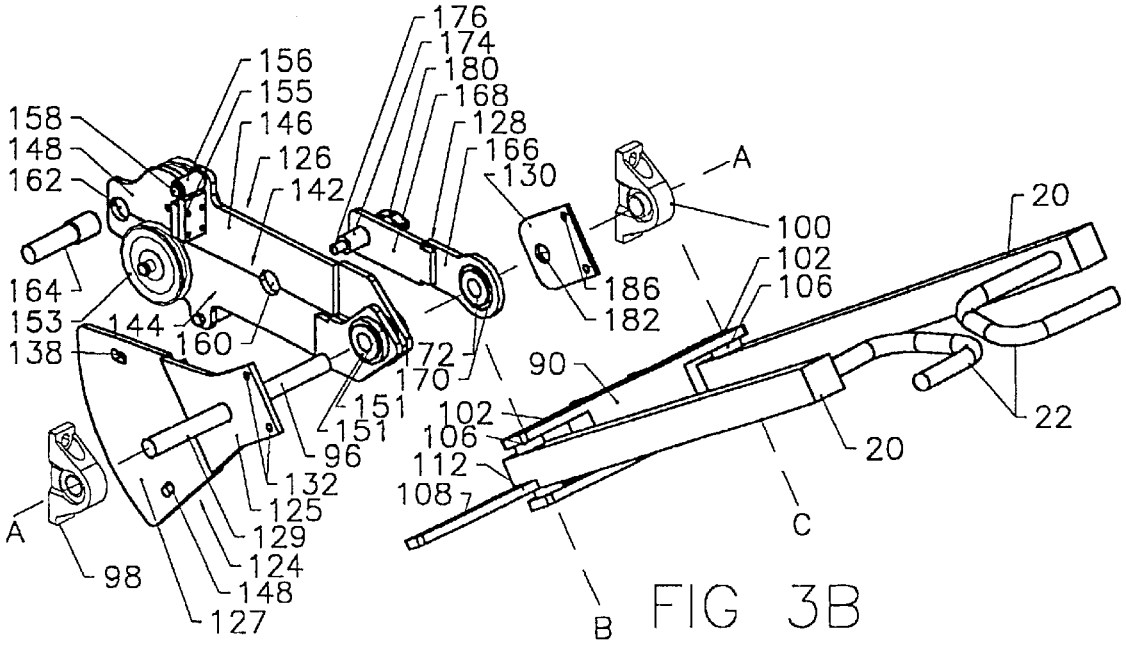

As best seen in FIGS. 3A and 3B, the conversion arrangement 40 is comprised of a fan-shaped, range control plate 124, a two-part, resistance lever assembly 126, a pin-carrying plate assembly 128 and a planar mounting plate 130, all of which are located between the pillow block bearings 98,100 and mounted relative to the pivot shaft 96. The range control plate 124 consists of two pieces 125,127 of plate steel which are welded together to provide an offset. The smaller piece 125 is formed with a central hole 129 through which the pivot shaft 96 is passed and around which the pivot shaft 96 is welded. Two small openings 132 are formed on the end of the piece 125 and are alignable with a pair of apertures 134 formed in the mounting tab 94 projecting rearwardly from the H-shaped body 90. Fasteners 136 (FIG. 6A) are used to connect the range control plate 124 to the mounting tab 92. The larger piece 127 is formed with a pair of spaced-apart upper and lower slots 138,140 respectively, which as will be appreciated, correspond to two distinct orientations of the lever arms 20 disposed in starting positions for defining two different exercise movements.

The resistance lever assembly 126 is pivotally mounted on the pivot shaft 96 and lies adjacent the range control plate 124. The resistance lever assembly 126 includes an upper resistance lever 142 and a lower resistance lever 144, each of which are mirror images of each other and include two pieces 146,148 of plate steel which are also welded together to provide an offset. Bearings 150 are installed on a proximal end of each lever 142,144 having an aperture 151 to allow rotation about the pivot shaft 96 and independent movement of each lever 142,144 relative to the other. Each lever 142,144 also has a distal end provided with a respective pulley 152,153 rotatably mounted thereon and a respective cable clamp 154,155 pivotably attached thereto by means of a sleeve 156 rotatably mounted on shaft 158. Mating edges of the resistance lever 142,144 are formed with cut-outs, so that when juxtaposed, a first circular hole 160 is formed admitting passage therethrough, and a second circular hole 162 opposite the aperture 151 has walls which surround a resistance arm stop 164 fixed on the upper end of stanchion 58 (FIG. 1).

The pin plate assembly 128 is comprised of two pieces 166,168 of plate steel which are welded together to form an offset. Bearings 170 are installed on a proximal end of the forwardmost plate 166 which is apertured at 172 to allow rotation about the pivot shaft 96. The rearwardmost plate 168 carries a spring pin body 174 in which a spring pin 176 is installed with a spring 178 which normally retains the pin 176 in an extended position. A retraction knob 180 is provided on the pin 176 such that when the knob 180 is pulled away from the plate assembly 128, the pin 176 is drawn into the spring pin body 174 compressing the spring 178. When the knob 180 is released, the spring 178 returns the pin 176 to its extended position. With the pin plate assembly mounted for rotation on pivot shaft 96, the pin 176 extends through the first hole 160 in adjacent resistance lever assembly 126 and is engaged in one of the slots 138,140 on the range control plate 124. The mounting plate 130 is formed with a hole 182 to allow it to be placed onto the pivot shaft 96. A set collar 184 is welded around the hole 182 to provide a means for securing the mounting plate 130 to the pivot shaft 96. Like the piece 125 on range control plate 124, the mounting plate 130 is formed with two small openings 186 bolted to the mounting tab 92 on body 90.

Figure 4:
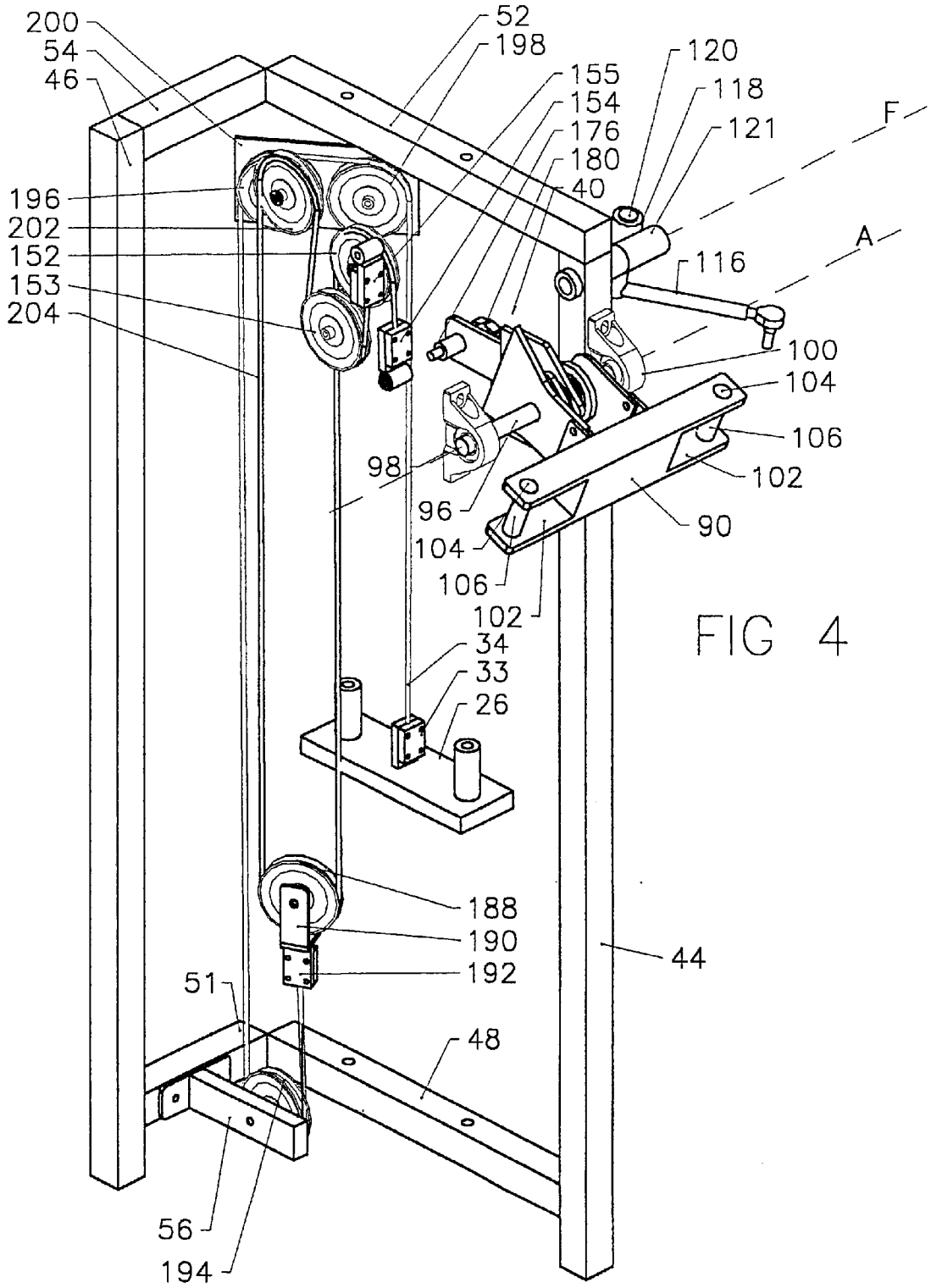
FIG. 4 is a fragmentary view like FIG. 2B but showing the pulley and cable arrangement used in the exercise machine.

With reference now to FIG. 4, the exercise machine 10 includes an idler pulley assembly comprised of a floating idler pulley 188 mounted for rotation in a bracket 190 having a cable clamp 192 depending therefrom. A lower guide pulley 194 is mounted for rotation upon the T-bar bracket 56 and at least one, but preferably two, upper guide pulleys 196,198 are mounted for rotation via a sandwiching plate assembly 200 (FIG. 2A) joined to the upper part of the frame 42. The support cable 34 has one end attached to the cable clamp 192 on idler pulley 188, is wound around the lower guide pulley 194, extends upwardly along the height of the frame 42, is wrapped around the upper guide pulleys 196, 198, and extends downwardly for connection with the cable clamp 33 at the top of the weight stack 26. A third upper guide pulley 202 is mounted for rotation on the outside of sandwiching plate assembly 200. A main cable 204 is attached to the cable clamp 155 on the upper resistance lever 142 and then wound around the pulley 153 on the lower resistance lever 144 and over the top of the third upper guide pulley 202, then downwardly around the idler pulley 188 and upwardly around the top of the pulley 152 on the upper resistance lever 142 for attachment to the cable clamp 154 on the lower resistance lever 144.

Figure 5A:
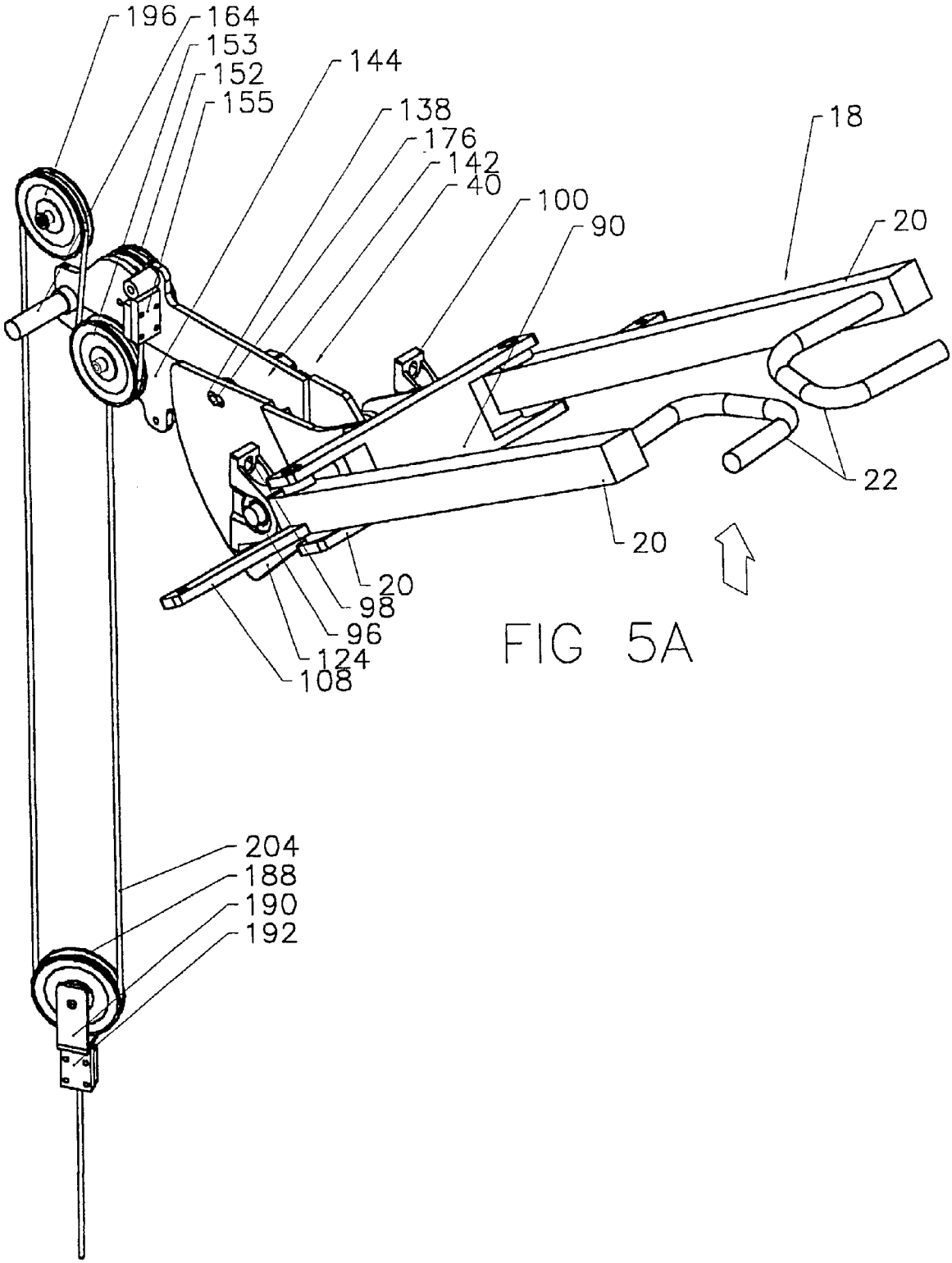
FIGS. 5A and 5B are further fragmentary views of the exercise machine in respective starting and finishing positions for a lat pull-down.

To position the machine 10 in the starting position for the pull-down movement as shown in FIG. 5A, the spring pin retraction knob 180 is pulled out. This draws the spring pin 176 inside the spring pin body 174 and disengages the spring pin 176 from the range control plate 124 allowing the lever arm assembly 18 to be rotated upward in the direction of the arrow without moving the upper resistance lever 142 or the lower resistance lever 144. The spring pin retraction knob 180 is then released, allowing the spring pin 176 to engage in the top slot 138 of the range control plate 124.

Figure 5B:
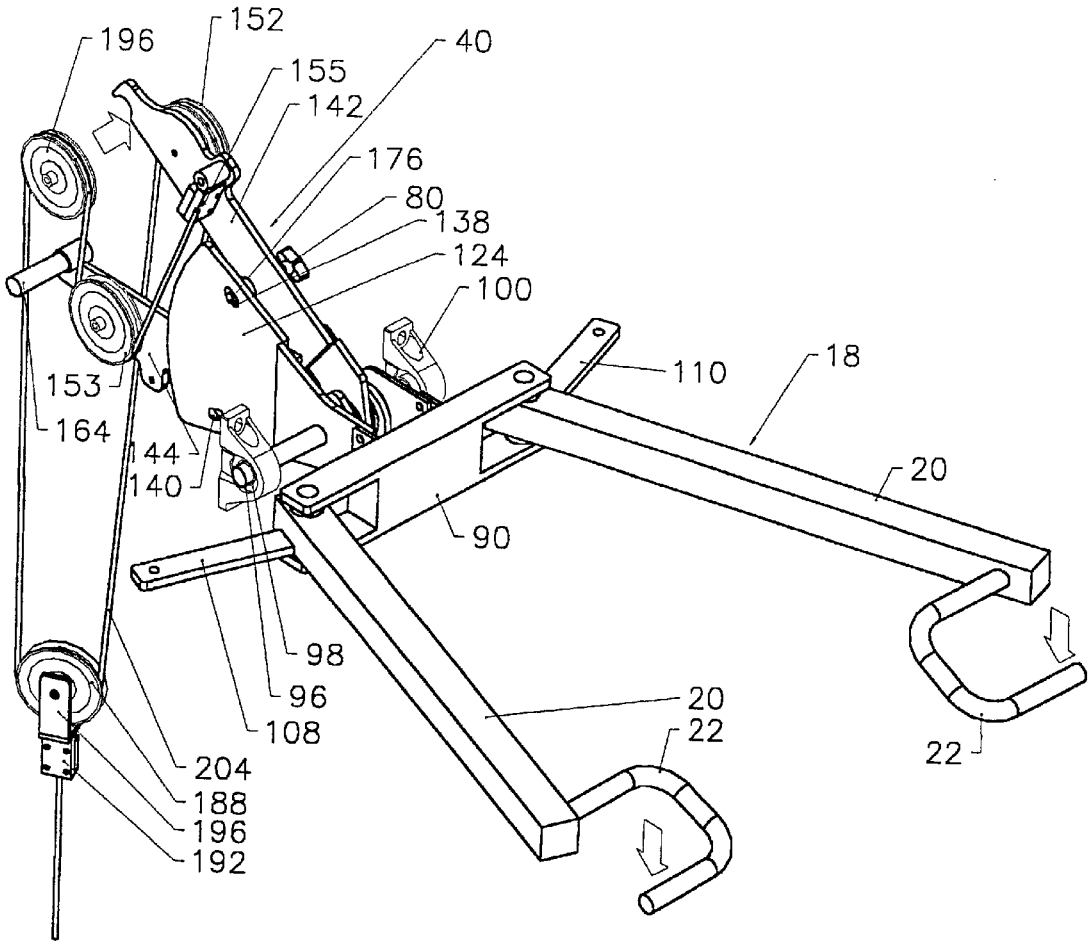

To effect the pull-down exercise, the operator sits on the seat bottom 14 with his/her chest against the rest 16 and knees engaged under the cushions 88. When the operator of the machine pulls down in the direction of the arrow (FIG. 5B) on the lever arm assembly 18 by means for operator hand grips 22, the lever arm assembly 18 rotates on the main pivot shaft 96. This motion, because the range control plate 124 is attached to the lever arm assembly 18, causes the range control plate 124 to rotate upward which, in turn, causes the pivot plate assembly 128 to rotate with the range control plate 124 because the spring pin 176 has been engaged in the range control plate 124. The spring pin body 174 engages with the upper resistance lever 142 and causes the upper resistance lever 142 to rotate upward. The lower resistance lever 144 does not move because it is against the resistance arm stop 164. When the upper resistance lever 142 rotates upward, it causes the pulley 152 mounted on the upper resistance lever 142 to move away from the swiveling cable clamp 154 mounted on the lower resistance lever 144. The swiveling cable clamp 155 mounted on the upper resistance lever 142 is also caused to move away from the pulley 153 mounted on the lower resistance lever 144. This motion pulls the main cable 204 raising the idler pulley assembly. The idler pulley assembly is connected to weight stack 26, or some other resistance source, which is caused to be lifted when the idler pulley assembly is raised.

Figure 6A:
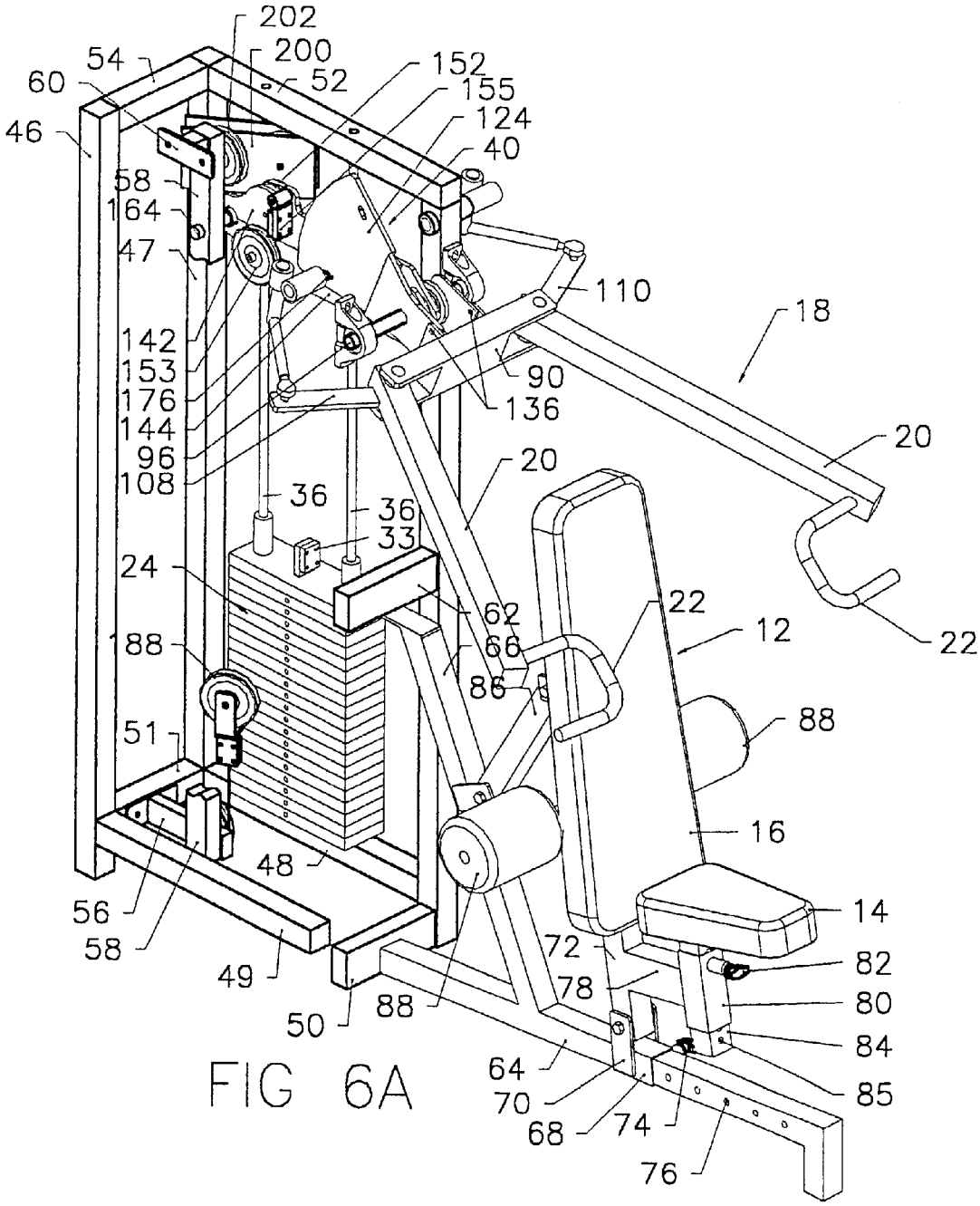
FIGS. 6A and 6B are fragmentary views of the exercise machine in respective starting and finishing positions for a shoulder press.
Figure 6B:
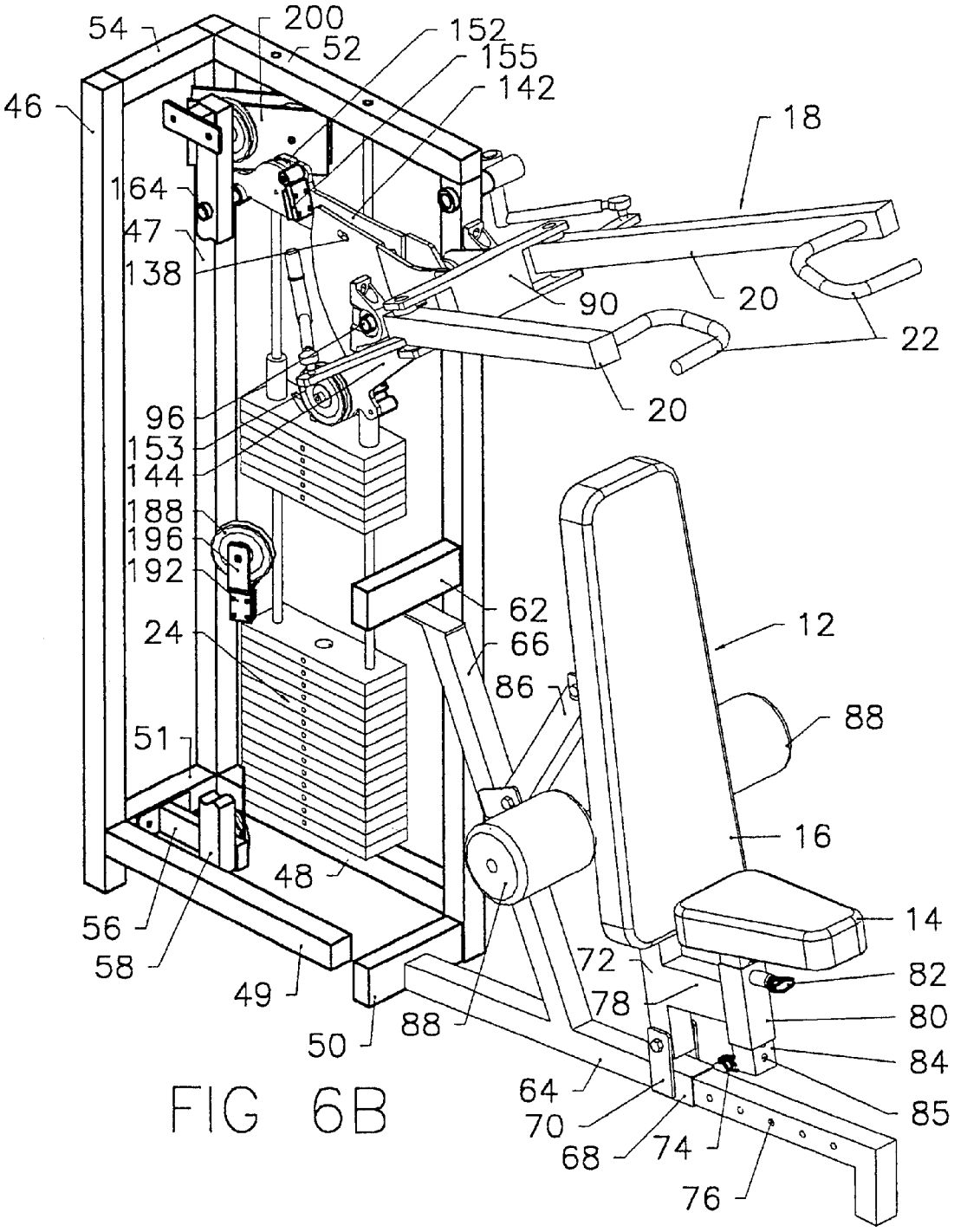
Figure 7A:
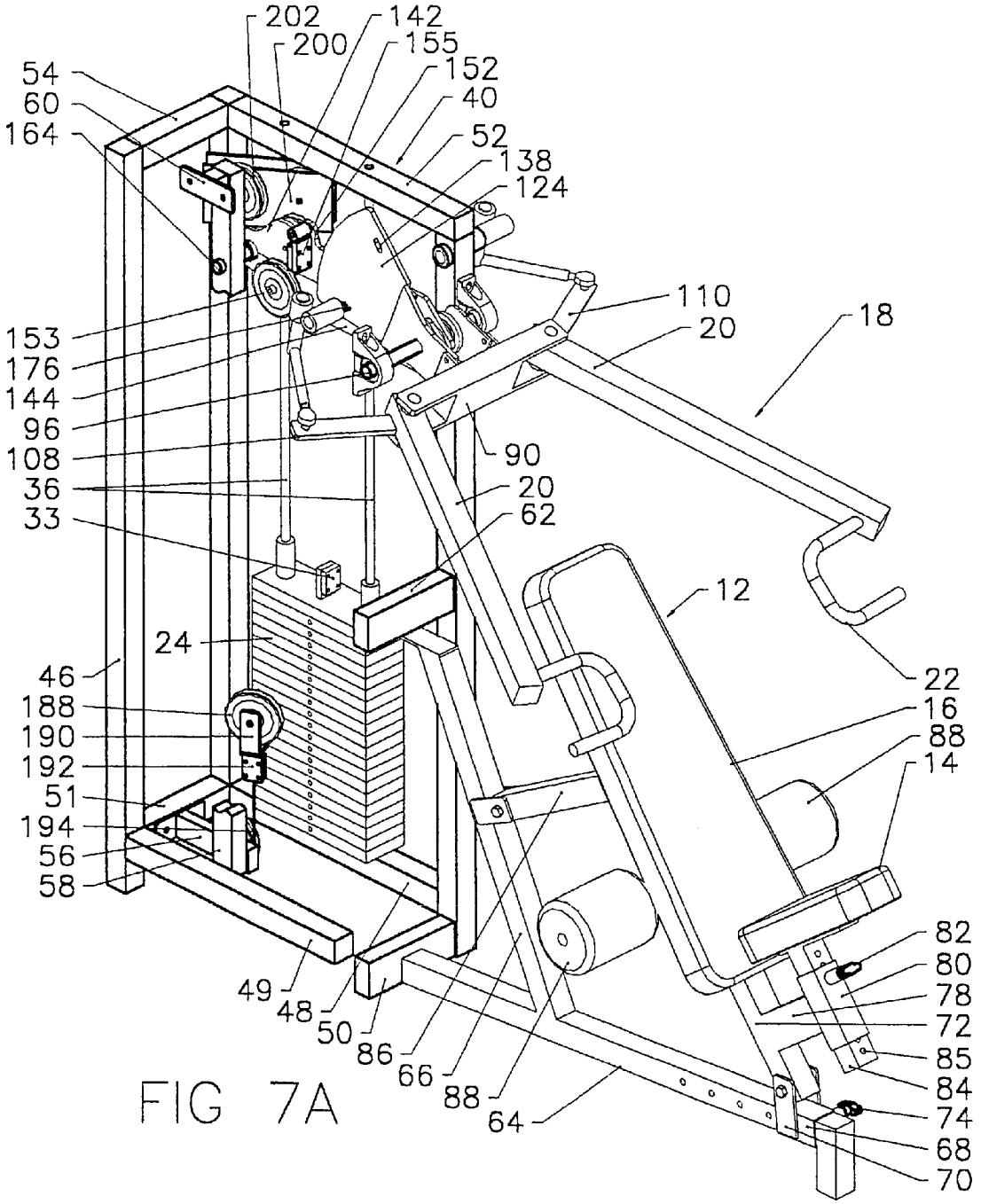
FIGS. 7A and 7B are fragmentary views of the exercise machine in respective starting and finishing positions for an inclined bench press.
Figure 7B:
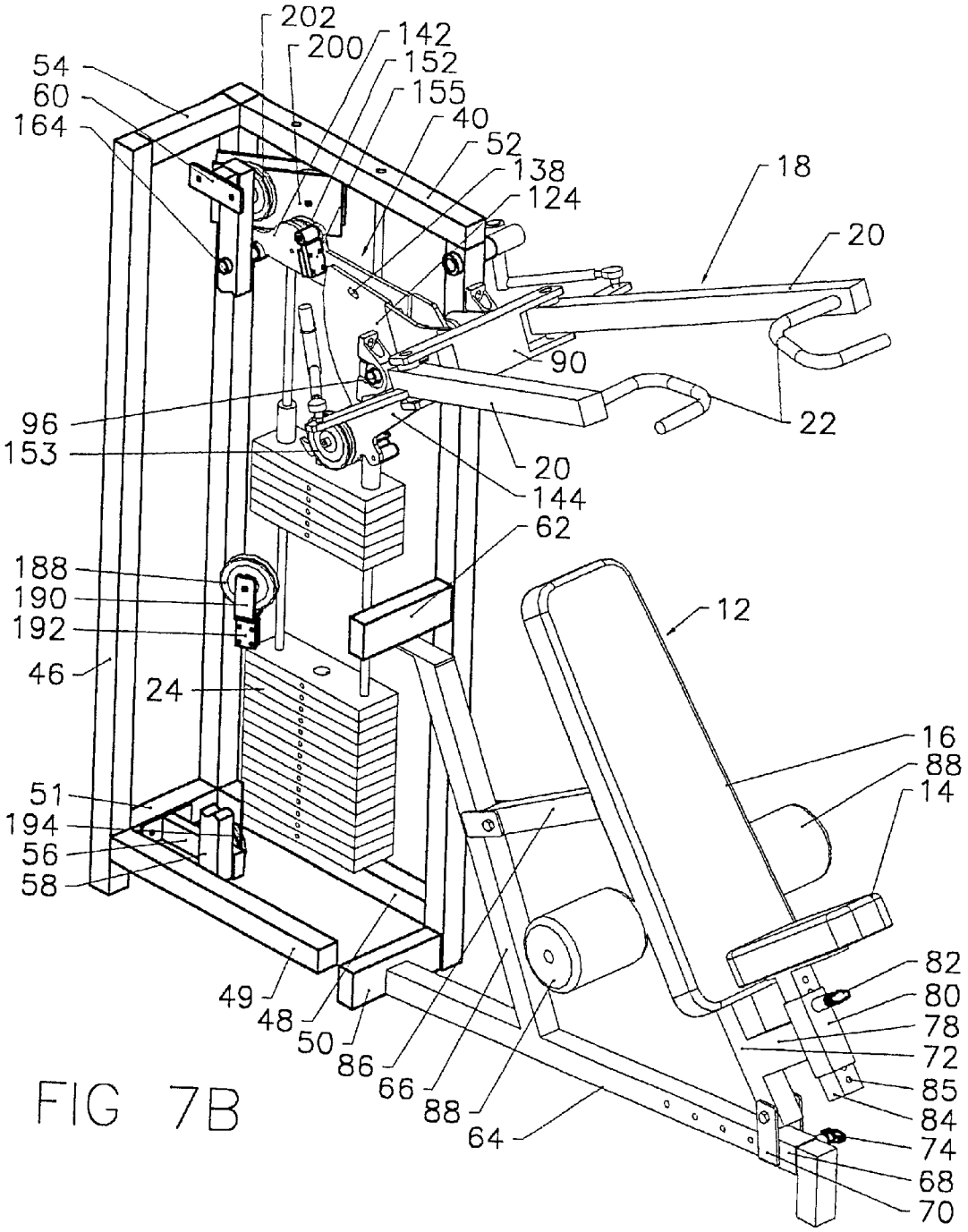

To position the machine 10 in the starting position for the shoulder press/bench press movement, as shown in FIGS. 6A and 7A, respectively, the spring pin retraction knob 180 is pulled out. This draws the spring pin 176 inside the spring pin body 174 and disengages the spring pin 176 from the range control plate 124 allowing the lever arm assembly 18 to be rotated downward without moving the upper resistance lever 142 or the lower resistance lever 144. The spring pin retraction knob 180 is then released, allowing the spring pin 176 to engage in the bottom slot 140 of the range control plate 124. To effect the shoulder press exercise, the operator sits on the seat bottom 14 with his/her back against the rest 16 which is generally in a nearly vertical position (FIG. 6A). To effect the inclined bench exercise, the operator sits on the seat bottom 14 with his/her back against the rest 16 which is placed in an inclined position (FIG. 7A) by moving the sleeve 68 into a forwardmost position. When the operator of the machine 10 pushes up (FIGS. 6B or 7B) on the lever arm assembly 18 by means of the operator hand grips 22, the lever arm assembly 18 rotates on the main pivot shaft 96. This motion, because of range control plate 124 being attached to lever arm assembly 18, causes the range control plate 124 to rotate downward which, in turn, causes the pin plate assembly 128 to rotate with the range control plate 124 because the spring pin 176 is engaged in the range control plate 124. The spring pin body 174 engages with the lower resistance lever 144 and causes the lower resistance lever 144 to rotate downward. The upper resistance lever 142 does not move because it is against the resistance arm stop 164.

When the lower resistance lever 144 rotates downward, it causes the pulley 153 mounted on the lower resistance lever 144 to move away from the swiveling cable clamp 155 mounted on the upper resistance lever 142. The swiveling cable clamp 154 mounted on the lower resistance lever 144 is also caused to move away from the cable pulley 152 mounted on the upper resistance lever 142. This motion pulls the main cable 204 raising the idler pulley assembly 188,190,192. The idler pulley assembly is connected to weight stack 26, or some other resistance source which is caused to be lifted when the idler pulley assembly is raised.

Figure 8A:
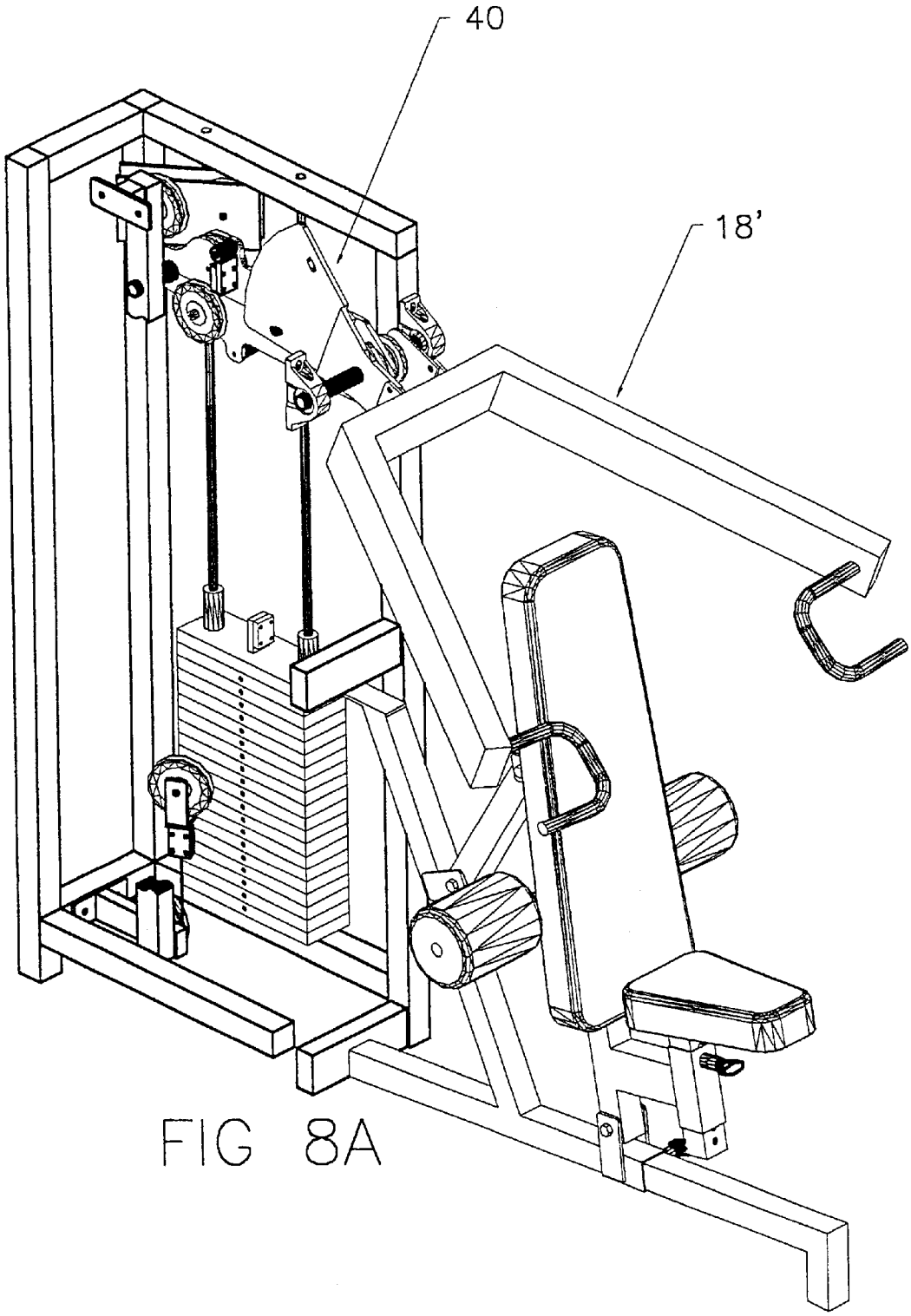
FIGS. 8A and 8B are fragmentary views of a multi-function exercise machine similar to FIGS. 5A and 5B but showing an alternative lever arm assembly.
Figure 8B:
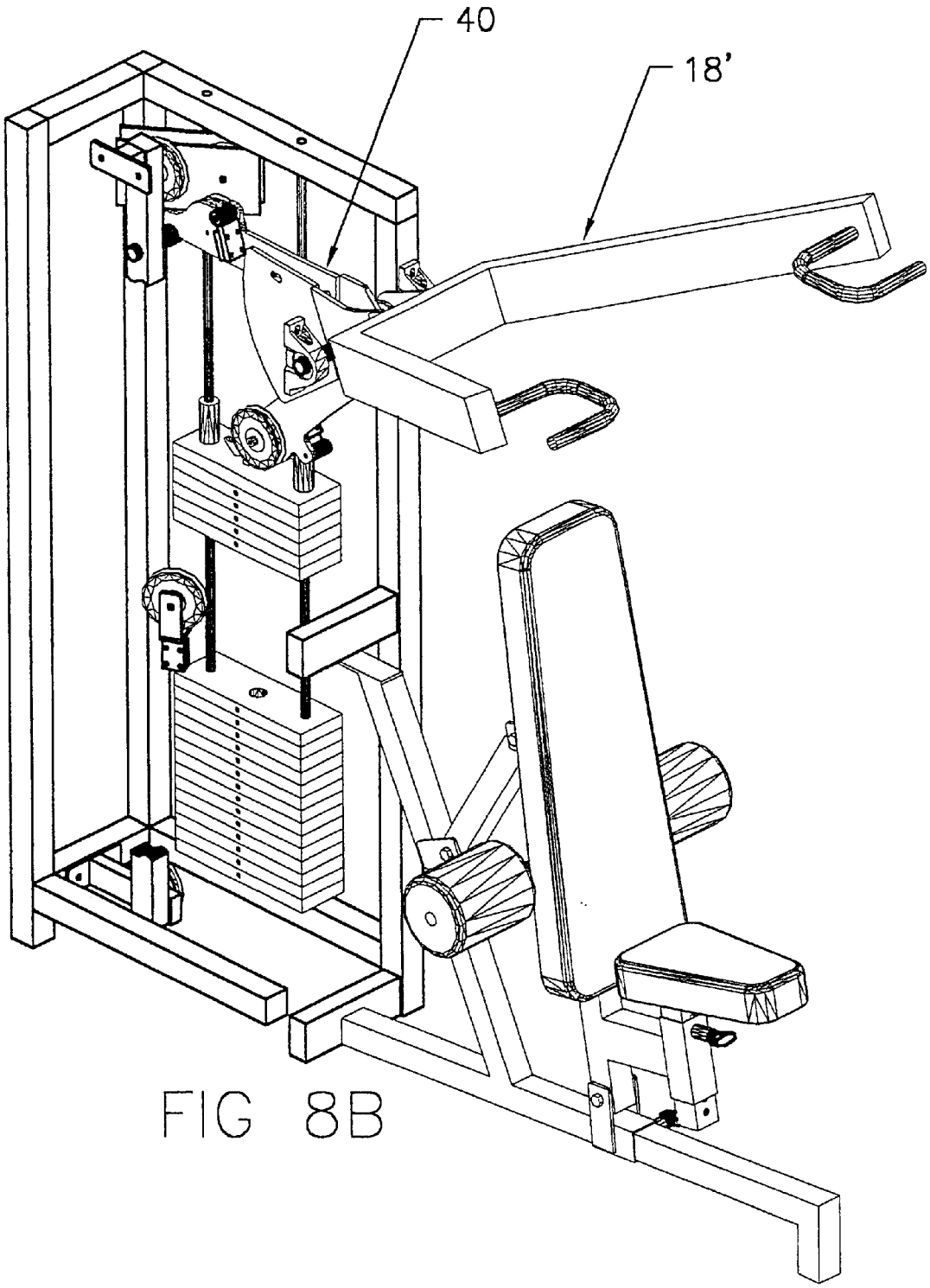

It is to be noted that the inclusion of the above-described motion translation arrangement enables an exerciser's hands to rotate or supenate naturally through 20° to 30° as the lever arms 20 are moved. That is, movement of the lever arms 20 and carriage 90 about the major and minor horizontal axes A and F, respectively, will be translated into lateral motion of the lever arms 20 about the pivot axes B and C, such that each lever arm 20 moves in a curved path from a first location to a second location. However, it should be fully understood from FIGS. 8A and 8B that the conversion arrangement 40 may be used with a lever arm assembly 18' having simple up and down motion rather than compound movement.

The present invention thus provides a full range exercise machine which can be conveniently converted by a simple spring pin setting to enable an exerciser to perform exercises for different muscle groups (in this case shoulders, chest and back) in a single seat machine. Such an apparatus is particularly attractive in that it occupies less space than other well-known multi-function exercise machines such as a Universal gym. With the incorporation of the motion translation arrangement, the exercise machine disclosed herewith much more easily accommodates the musculoskeletal makeup of the exerciser's body without stress to the joints.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth in the following claims.

We claim:

1. A single station, exercise machine comprising:

a frame;

a seat adjustably mounted on the frame;

a rest attached to the frame rearwardly of the seat for supporting the upper torso of an exerciser;

a lever arm assembly including a pair of lever arms movably connected relative to the frame about at least one horizontal pivot shaft between a starting position and a finishing position;

structure on the frame for resisting movement of the lever arm assembly; and a conversion arrangement defined by a spring pin-actuated, movable plate, pulley and cable combination connected between the frame and the lever arms for changing the starting position of the lever arms so as to provide for different exercise movements, wherein the conversion arrangement includes, a range control plate fixed to the pivot shaft and the lever assembly and having a set of slots formed therein;

a resistance lever assembly pivotably mounted on the pivot shaft adjacent the range control plate, the resistance lever assembly comprising an upper resistance lever and a lower resistance lever;

a pin plate assembly pivotably mounted on the pivot shaft adjacent the resistance lever assembly, the pin plate assembly including a pin biased into engagement with one of the slots in the range control plate; and a mounting plate fixed to the lever arm assembly adjacent the pin plate assembly and having an opening through which the pivot shaft passes, whereby the starting position of the lever arm assembly is established by the position of the pin in one of the slots of the range control plate.

2. The exercise machine of claim 1, wherein each of the resistance levers having a proximal end being mounted about the pivot shaft for independent movement relative to the other resistance lever and having a distal end provided with a pulley rotatably mounted thereon and a cable clamp movably fixed thereto.

3. The exercise machine of claim 2, wherein the distal end of each upper and lower resistance lever is engageable with a stop mounted on the frame of the machine.

4. The exercise machine of claim 1, wherein the pin of the pin plate assembly extends through the resistance lever assembly.

5. The exercise machine of claim 3, including a floating idler pulley, a first guide pulley mounted to the lower portion of the frame, at least one second guide pulley mounted to an upper portion of the frame, and a support cable connected to the idler pulley, wound about the first guide pulley and second guide pulley and joined to the resisting structure.

6. The exercise machine of claim 5, including a third guide pulley mounted to an upper portion of the frame and a main cable attached to the cable clamp on the upper resistance lever and wound around the pulley on the lower resistance lever, the third guide pulley, the idler pulley, and the pulley on the upper resistance member and attached to the cable clamp on the lower resistance lever.

7. The exercise machine of claim 1, including a motion translation arrangement connected to the lever arms and pivotably connected to the frame about at least one horizontal axis and defining a pair of spaced, parallel angularly-oriented, pivot axes lying perpendicularly to the horizontal axis.

8. The exercise machine of claim 1, including a carriage pivotably mounted to the frame about a major horizontal axis and a minor horizontal axis located substantially parallel to the major horizontal axis, the carriage defining a pair of spaced, parallel, angularly-oriented, pivot axes lying perpendicularly to the major and minor horizontal axes, and having a pair of transfer linkages, each linkage being rigidly connected at one end to one of the lever arms and pivotally connected at another end to the frame about the minor horizontal axis, wherein movement of the lever arms and carriage about the major and minor horizontal axes will be translated into lateral motion of the lever arms about the pivot and translated into lateral motion of the lever arms about the pivot axes such that each lever arm moves in a curved path from one location to a second location.

9. The exercise machine of claim 8, wherein each transfer linkage is comprised of a rigid mounting arm connected to one of the lever arms, and a transfer link extends rearwardly of the mounting arm and is connected between the mounting arm and the frame.

10. The exercise machine of claim 1, wherein the machine is constructed and arranged to selectively provide a shoulder pressing motion, an inclined bench pressing motion and a lat pull-down motion.

11. The exercise machine of claim 1, wherein the resisting structure is a weight stack.

* * * * *